US012588796B2

(12) United States Patent
Sartori

(10) Patent No.: US 12,588,796 B2
(45) Date of Patent: Mar. 31, 2026

(54) DOOR OPENER FOR A DOMESTIC APPLIANCE

(71) Applicant: ILLINOIS TOOL WORKS INC., Glenview, IL (US)

(72) Inventor: Nicola Sartori, Barasso (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 160 days.

(21) Appl. No.: 18/278,899

(22) PCT Filed: Feb. 28, 2022

(86) PCT No.: PCT/US2022/018072
§ 371 (c)(1),
(2) Date: Aug. 25, 2023

(87) PCT Pub. No.: WO2022/187111
PCT Pub. Date: Sep. 9, 2022

(65) Prior Publication Data

US 2024/0292999 A1 Sep. 5, 2024

(30) Foreign Application Priority Data

Mar. 1, 2021 (EP) ..... 21159897

(51) Int. Cl.
*A47L 15/42* (2006.01)

(52) U.S. Cl.
CPC ..... *A47L 15/4259* (2013.01)

(58) Field of Classification Search
CPC ..... A47L 15/4259
See application file for complete search history.

(56) References Cited

U.S. PATENT DOCUMENTS 3,326,064 A * 6/1967 Ordorica, Jr. ..... F16H 48/22 475/240
4,548,309 A * 10/1985 Braun ..... F16F 15/1207 192/214.1
5,396,945 A * 3/1995 Meyer ..... E06B 9/322 160/177 R

FOREIGN PATENT DOCUMENTS

DE 199 60 814 A1 6/2001
DE 19528901 B4 * 8/2004 ..... D06F 39/125
(Continued)

OTHER PUBLICATIONS

European Patent Office (EPO), Rijswijk, NL, International Search Report, Form PCT/ISA/210 for International Application No. PCT/US2022/018072, Jun. 2, 2022 (2 pp.).
(Continued)

*Primary Examiner* — Michael E Barr
*Assistant Examiner* — Kevin G Lee
(74) *Attorney, Agent, or Firm* — Pauley Erickson & Swanson

(57) ABSTRACT

A door opener for a domestic appliance includes a motor and a pusher member having a rack portion. The pusher member is displaceable between a retracted position and an extended position in which it is engageable with a door of a domestic appliance in order to open the door, and a gear train connected between the output of the motor and the rack portion of the pusher member, which causes displacement of the pusher member in response to operation of the motor. The gear train comprises an overload clutch which comprises a first gear and a second gear mounted coaxially with, and rotatable with respect to, the first gear. The second gear comprises a plurality of resiliently deformable fingers, one end of each finger being releasably engageable with a complementarily-shaped portion of the first gear.

15 Claims, 7 Drawing Sheets

(56) References Cited

FOREIGN PATENT DOCUMENTS

| | | | |
|---|---|---|---|
| WO | WO 2016/199056 | A1 | 12/2016 |
| WO | WO 2018/121575 | A1 | 7/2018 |

OTHER PUBLICATIONS

European Patent Office (EPO), Munich, DE, Written Opinion of the Int'l Searching Authority for Int'l Appln No. PCT/US2022/018072, Form PCT/ISA/237, Jun. 2, 2022 (10 pp.).
"Young's modulus-Wikipedia", https://batavia.internal.epo.org/citenpl/citation/prod/pdf/3310b742-4e6b-3623-bb52-34f39ab8c448.pdf, Sep. 22, 2024, (11 pages).
EPO Form 2001 "Communication pursuant to Article 94(3) EPC", for European Patent Application No. 22 708 707.9, issued Feb. 2, 2025 (8 pages).

* cited by examiner

DOOR OPENER FOR A DOMESTIC APPLIANCE

CROSS REFERENCE TO RELATED APPLICATION

This application is a National Phase filing of PCT International Patent Application PCT/US2022/018072, filed on 28 Feb. 2022, which claims the priority of European Patent Application No. EP 21159897.4, filed 1 Mar. 2021.

These applications are hereby incorporated by reference herein in their entirety and is made a part hereof, including but not limited to those portions which specifically appear hereinafter.

TECHNICAL FIELD OF INVENTION

The present invention relates to door openers for domestic appliances and in particular, but not exclusively, to door openers for dishwashers.

INTRODUCTION

The final stage of a typical dishwasher cycle is a drying stage in which the air within the dishwasher is heated in order to evaporate water from the objects being cleaned. It has been found that accelerated drying of the objects within the dishwasher can be achieved by partially opening the door during the drying stage in order to promote evaporation.

It is known to provide a dishwasher with a device which automatically partially opens the door of the dishwasher during the drying cycle, typically by a few centimetres. One known device comprises a pusher member which can be displaced, by operation of a motor, between a retracted position and an extended position in which the pusher member engages with the door of the dishwasher during the drying cycle in order to pivot the door open.

Typically, a reduction gear train is connected between the output of the motor and the pusher member, e.g. a rack portion of the pusher member. It is known to provide an overload clutch within the reduction gear train to minimise damage in the event that displacement of the pusher member is inhibited, for example if the dishwasher door is prevented from opening. However, since the opening device is used in conditions of relatively high humidity, it is desirable that the overload clutch should contain as little metal as possible in order to reduce the likelihood of corrosion.

SUMMARY OF THE INVENTION

In accordance with a first aspect of the present invention, a door opener for a domestic appliance comprises:

- a motor;
- a pusher member displaceable between a retracted position and an extended position in which it is engageable with a door of a domestic appliance in order to open the door; and
- a gear train connected between the output of the motor and the pusher member, which causes displacement of the pusher member in response to operation of the motor;
- the gear train comprising an overload clutch which comprises:
- a first gear; and
- a second gear mounted coaxially with, and rotatable with respect to, the first gear;

- the second gear comprising a plurality of resiliently deformable fingers, one end of each finger being releasably engageable with a complementarily-shaped portion of the first gear.

With such a door opener, when the torque transmitted through the first and second gears exceeds the value which is sufficient to bend the fingers, the fingers can disengage from the complementarily-shaped portions of the second gear, allowing the first and second gears to rotate with respect to one another and interrupting the transmission of motion through the gear train to the pusher member. This minimises damage to the door opener and to the appliance to which the opener is fitted, in the event that the pusher member is unable to open the door of the appliance or if the door of the appliance is slammed shut when the pusher member is in its extended position.

In addition, it is possible to form the first and second gears of the overload clutch from non-metallic materials. This reduces the number of components required in the clutch and avoids the need for the mounting of one or more elastic metal components which requires a preload (and usually a tool) for correct mounting. In addition, the use of non-metallic materials reduces the likelihood of corrosion, and therefore malfunction.

The resiliently deformable fingers are preferably resiliently flexible or bendable. For example, the resiliently deformable fingers may be flexible or bendable inwardly. Preferably, the resiliently deformable fingers are equally angularly spaced with respect to one another.

In one embodiment, the second gear comprises a core from which the resiliently deformable fingers extend outwardly.

In one embodiment, one end of each finger is releasably engageable with a complementarily-shaped recess of the first gear.

The first gear may comprise a peripheral annular rim in which the complementarily-shaped portions are formed.

The second gear may be seated in a recess in the first gear formed by the peripheral annular rim.

In one embodiment, the second gear comprises an output gear.

Preferably, the elongate pusher member is displaceable in its longitudinal direction.

In one embodiment, the pusher member comprises a rack portion and the gear train is connected between the output of the motor and the rack portion.

Preferably, the rack portion extends parallel to the longitudinal direction of the pusher member.

Preferably, the second gear is engaged with the rack portion of the pusher member.

The present invention also includes a domestic appliance comprising a door opener in accordance with the present invention, for example a dishwasher comprising a door opener in accordance with the present invention.

BRIEF DESCRIPTION OF THE DRAWINGS

By way of example only, a specific embodiments of the present invention will now be described with reference to the accompanying drawings, in which.

DESCRIPTION

Figure 1:
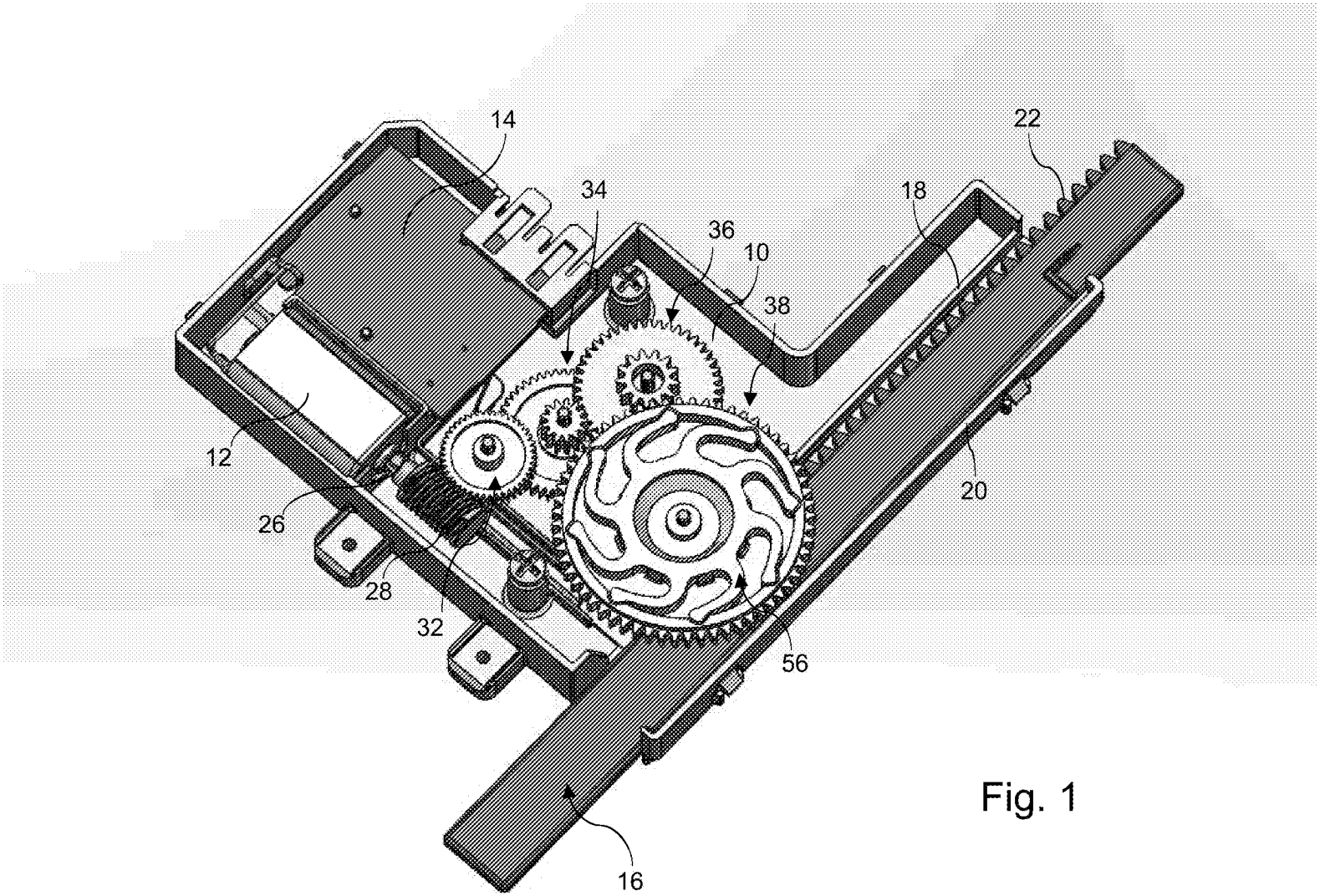
FIG. 1 is a perspective view from above of an embodiment of door opener in accordance with the present invention.

The door opener shown in FIG. 1 comprises a pressed base plate 10 made of plastics material, on which an electric motor 12 is mounted. A printed circuit board 14 is mounted on the base plate 10 adjacent to the motor 12 for controlling the operation of the motor 12.

An elongate pusher member 16 is slidably mounted on the base plate 10 and is constrained to be movable in its longitudinal direction along an elongate channel defined between upstanding parallel elongate flanges 18, 20 projecting perpendicularly from the base plate 10. The elongate pusher member 16 comprises an elongate flat straight bar made of plastics material. The inner edge of the pusher member 16 is formed into a toothed rack portion 22 which extends for approximately two thirds of the length of the pusher member. As will be explained, the pusher member is displaceable in its longitudinal direction along the channel between the elongate flanges 18, 20 between a retracted position (illustrated in FIGS. 1 to 3) and an extended position (illustrated in chain dot in FIG. 2) in which the end of the pusher member 16 which does not have the rack portion 22 projects further from the base plate 10.

The output shaft 26 of the motor 12 drives a worm screw 28 whose rotation is transmitted via a gear train comprising three compound gears 32, 34, 36 and an overrun clutch 38 having an output pinion 40 (see FIG. 3) which engages with the toothed rack portion 22 of the pusher member 16. Therefore, operation of the motor to rotate its output shaft 26 results in longitudinal displacement of the pusher member 16.

Figure 2:
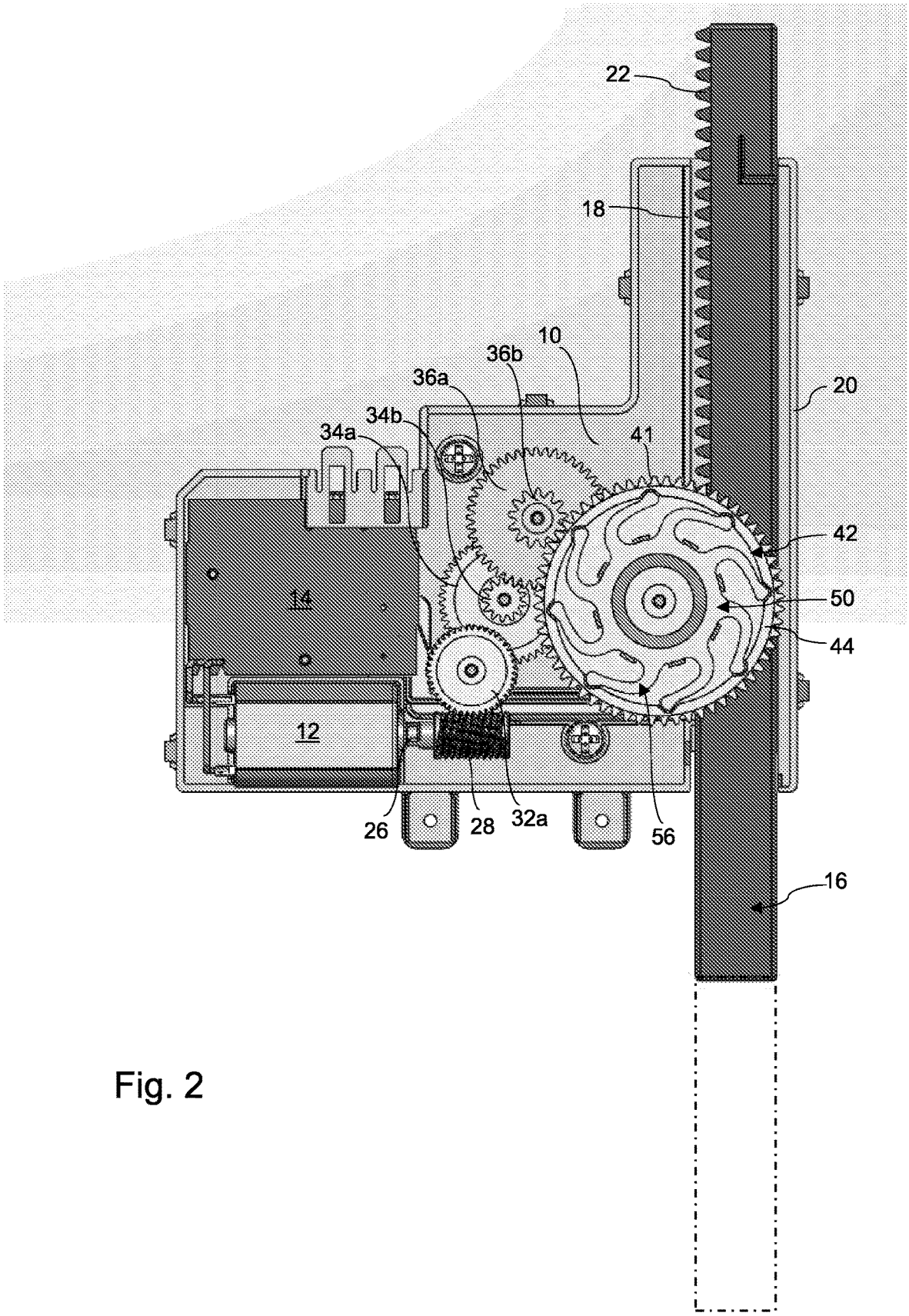
FIG. 2 is a plan view of the door opener of FIG. 1.
Figure 3:
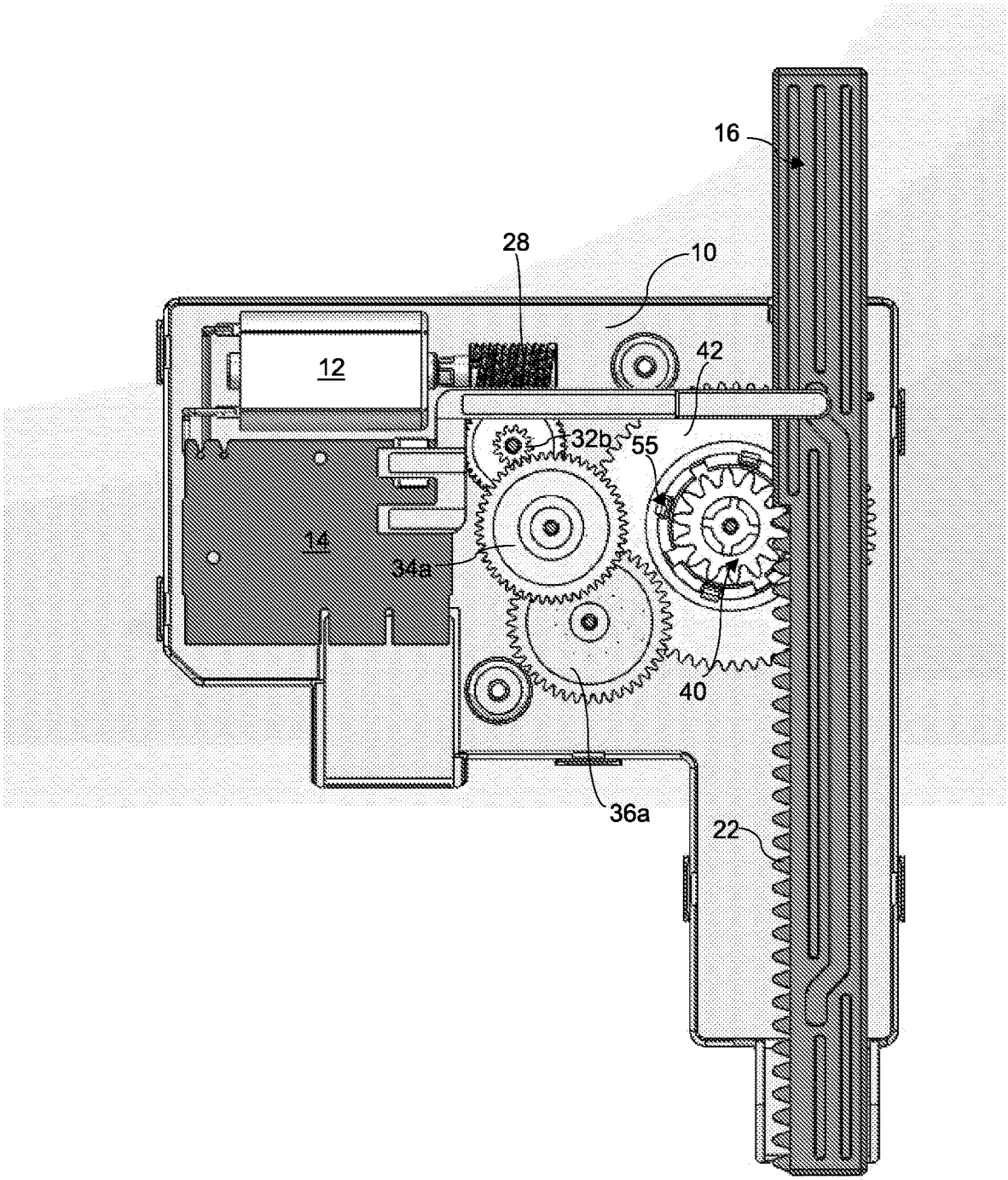
FIG. 3 is an inverted plan view of the door opener of FIG. 1.
Figure 4:
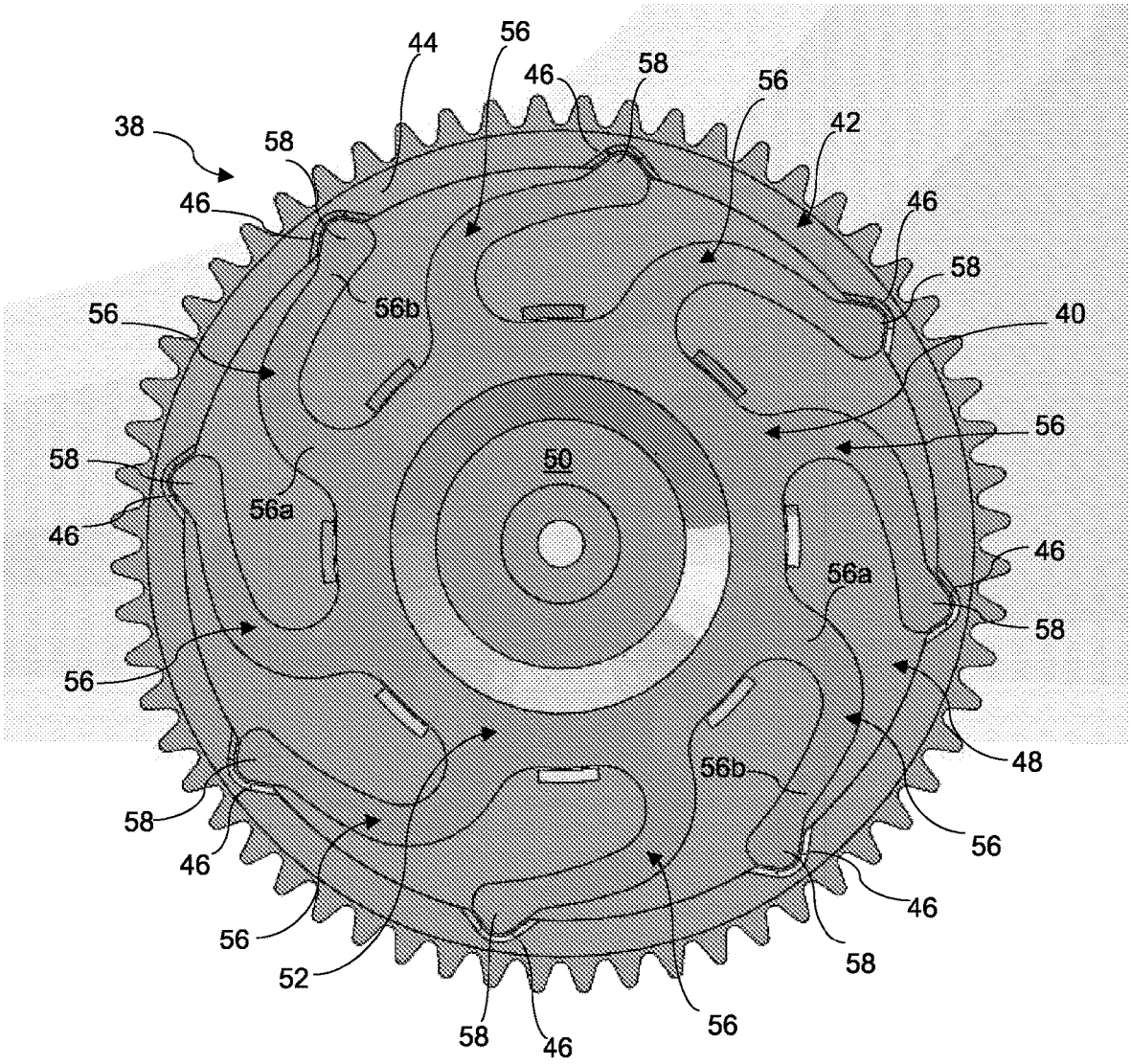
FIG. 4 is a plan view of an overload clutch which forms part of the door opener of FIG. 1.
Figure 5:
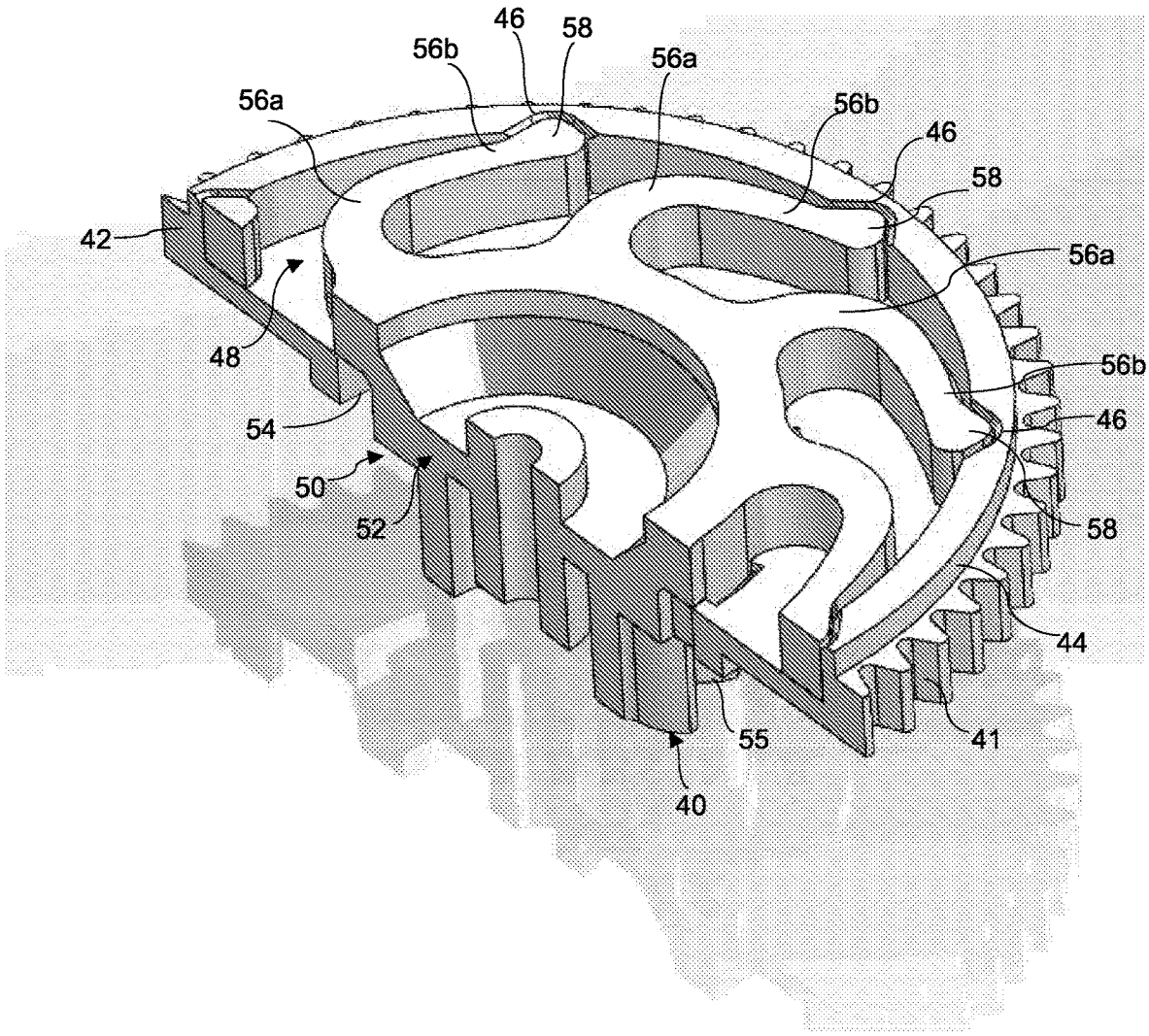
FIG. 5 is a perspective view from above, in vertical cross-section, of the overload clutch of FIG. 4.

Each of the compound gears 32, 34, 36 is formed from plastics material and is generally conventional, and each comprises a larger pinion 32*a*, 34*a*, 36*a* and a smaller pinion 32*b*, 34*b*, 36*b* mounted coaxially with, and constrained to rotate with, the larger pinion. The gear train is a reducing gear train whereby the larger pinion 32*a*, 34*a*, 36*a* forms the input and the smaller pinion 32*b*, 34*b*, 36*b* forms the output of each compound gear. The larger pinion 32*a* of the first compound gear 32 forms a worm gear driven by the worm screw 28 connected to the output shaft 26 of the motor 12 and each of the smaller pinions 32*b*, 34*b*, meshes with the larger pinion 34*a*, 36*a* respectively with the next compound gear 34, 36 in the gear train. As best seen in FIG. 2, the smaller output pinion 36*b* of the final compound gear 36 engages with the teeth 41 of a circular input gear 42 to which forms one component of the overrun clutch 30.

The circular input gear 42, which is conveniently formed from a plastics material, is provided with an upstanding peripheral rim 44 inwardly of the peripheral teeth 41 which is provided with eight identical recesses 46 on its inner face, equally angularly spaced around the rim 44. The rim 44 forms a shallow recess 48 in the upper face of the input gear 42 which receives an output gear member 50 of the overrun clutch 30, arranged coaxially with the input gear 42.

Figure 6:
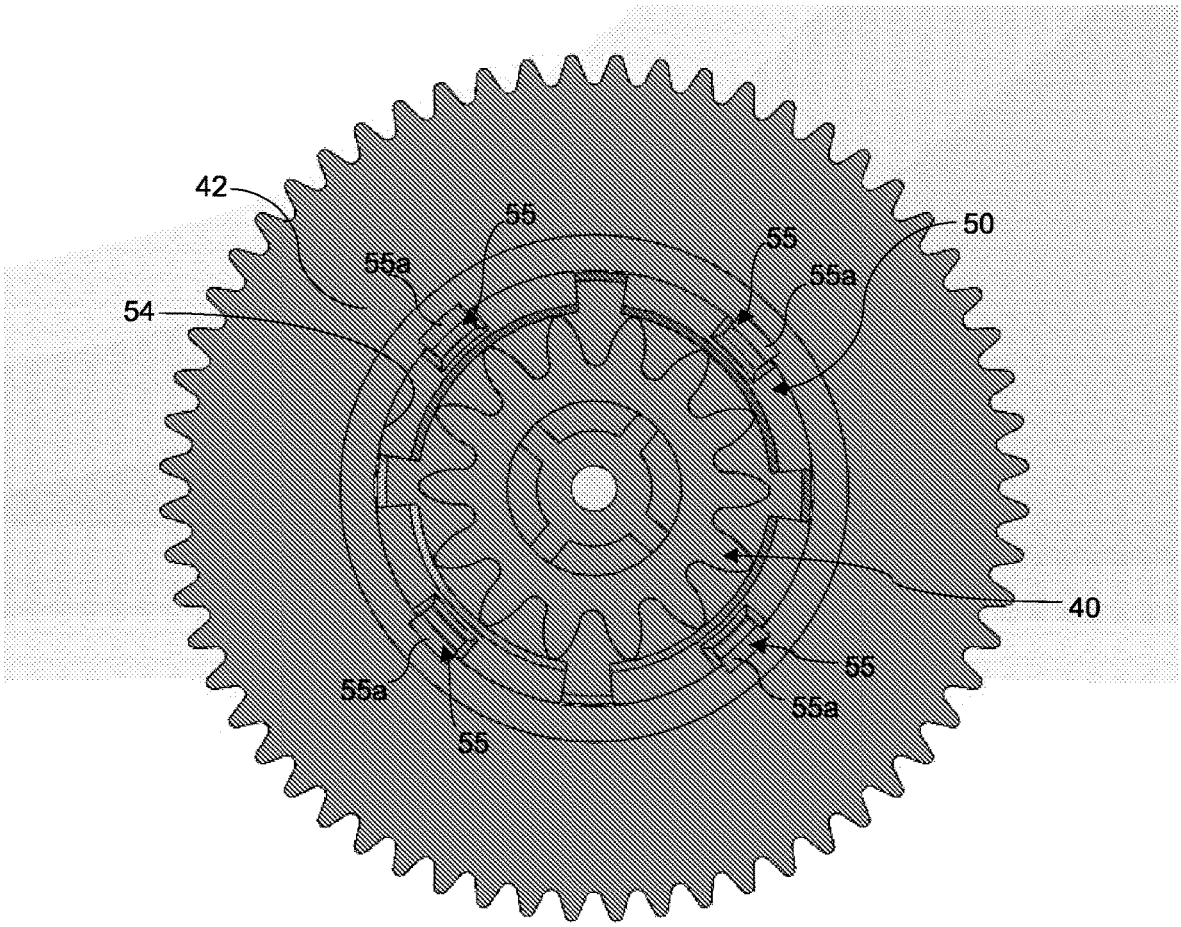
FIG. 6 is an inverted plan view of the overload clutch of FIG. 4.
Figure 7:
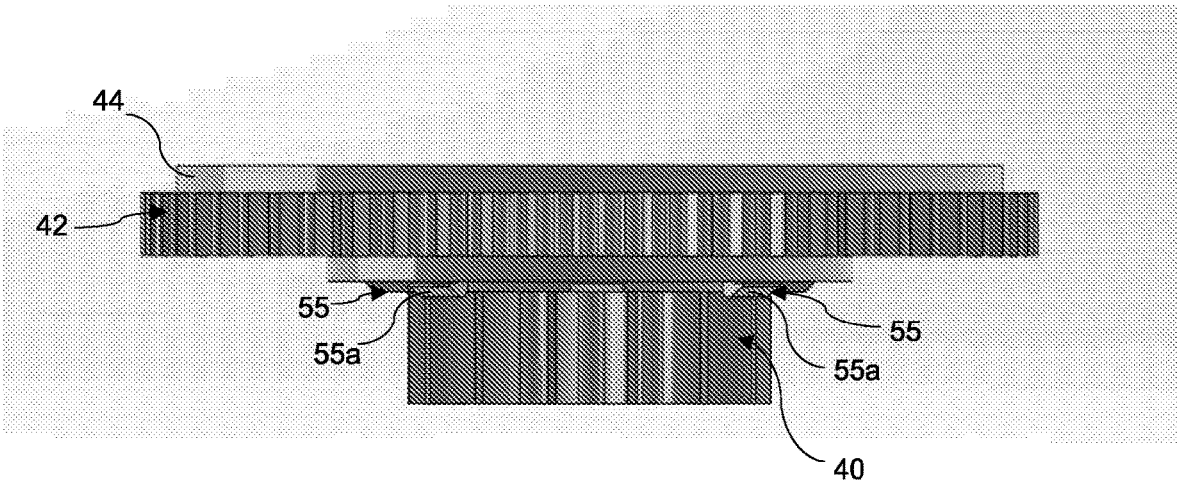
FIG. 7 is a side view of the overload clutch of FIG. 4.
Figure 8:
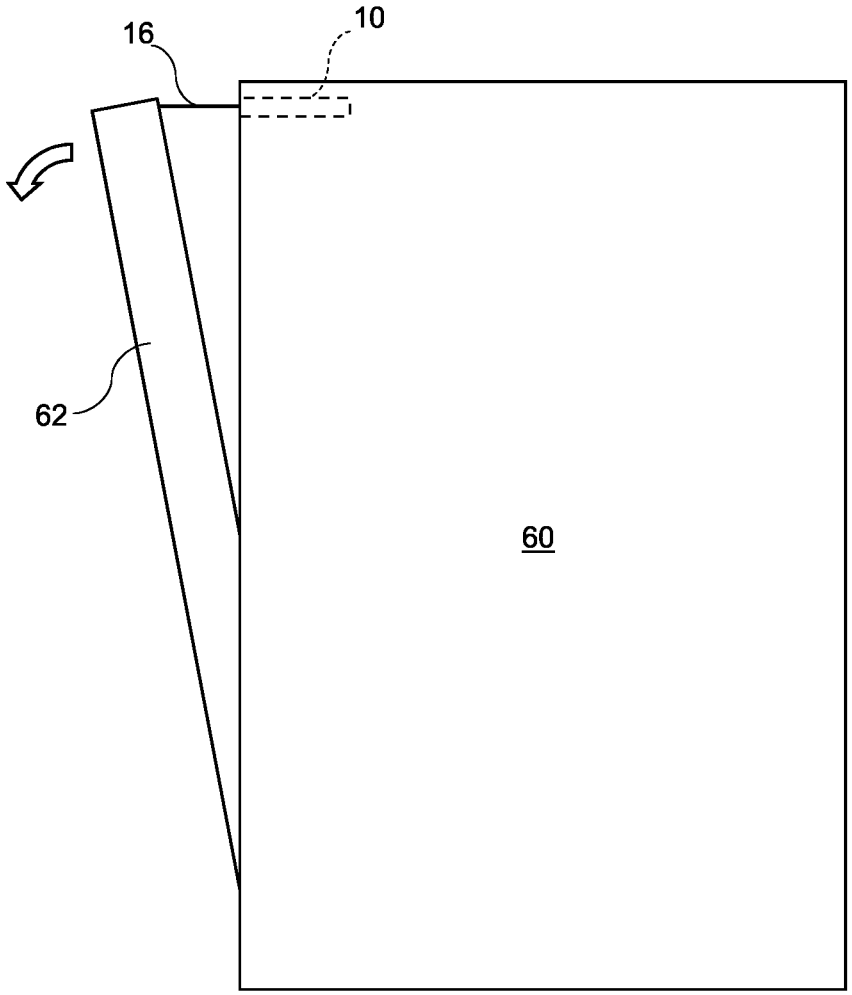
FIG. 8 is a schematic side view of a dishwasher fitted with a door opener in accordance with the present invention.

The output gear member 50 comprises the output pinion 40 which engages the rack portion 22 of the pusher member 16. The output pinion 40 forms part of a core 52 which passes through a complementarily-shaped circular aperture 54 in the centre of the input gear 42. As best seen in FIGS. 6 and 7, the rim of the undersurface of the output gear member 50 is provided with four integrally-formed resiliently deformable retaining teeth 55, equally angularly spaced around its periphery. The lower ends of the teeth 55 project slightly outwardly from the core 52 in a radial direction so that as the gear 50 is pushed into and through the aperture 54 in the input gear 42, the teeth 55 initially deform inwardly and then spring back to engage the undersurface of the gear 42. The outer, lowermost face of each tooth 55 is chamfered as shown at 55*a* to facilitate passing the gear member 50 through the aperture 54 and the upper surface of the head of each tooth 55 is flat for engagement with the undersurface of the gear 42. In this way, the input gear 42 and the output gear member are prevented from relative movement in an axial direction, while still allowing relative rotation.

As best seen in FIGS. 1, 2, 4 and 5, at the end of the core 52 remote from the output pinion 40, eight identical resiliently deformable fingers 56 extend outwardly from the core 52. The fingers 56 are equally angularly spaced around the periphery of the core 52 and the end of each finger is received in a respective one of the recesses 46 in the upstanding peripheral rim 44 of the input gear 42. The ends 58 of the fingers 56 are shaped to be a complementary fit to the shape of the recesses 46.

It will be observed that each of the fingers 56 does not extend radially from the core 52 to the peripheral rim 44. Instead, each finger 56 comprises a first portion 56*a* which extends generally radially which merges with a second portion 56*b* which curves in a clockwise direction (as seen in FIGS. 1, 2, 4 and 5) and terminate in the ends 58 which engage with the recesses 46 the peripheral rim 44 of the input gear 42.

The output gear member 50 is also formed of plastics material, and the fingers 56 are therefore flexible and resiliently deformable, to the extent that if the output gear member 50 is held stationary (for example if the pusher member 16 is prevented from moving) then continued application of a torque to the input gear 42 in the clockwise direction (as seen in FIGS. 1, 2, 4 and 5) by operation of the motor 12 will disengage the ends 58 of the fingers 56 from the respective recesses 46 in the peripheral rim 44 by allowing the fingers 56 to deflect inwardly, thereby allowing relative rotation between the input gear 42 and the output gear member 50. This prevents, or at least minimises, damage to the door opener assembly in the event that its normal operation is inhibited.

In use, the door opener assembly is fitted to the upper portion of a dishwasher 60 having a pivotally mounted door 62. During an appropriate point in the drying cycle of the dishwasher 60 (as determined by the printed circuit board 14 or the control of the dishwasher 60), the motor 12 is actuated which, as explained above, results in longitudinal displacement of the pusher member 16. The end of the pusher member 16 is positioned so that it engages an upper portion of the door 62 of the dishwasher and the door opener assembly is configured to apply sufficient force to open the door 62. The pusher member 16 is displaced so that the door 62 of the dishwasher 60 is opened by a few centimetres, sufficient to allow the hot air in the dishwasher to escape in order to enhance evaporation and drying of the contents of the dishwasher.

If the pusher member 16 is unable to open the door 62 of the dishwasher 60 upon actuation of the motor 12 (for example if the door 62 is locked shut or otherwise prevented from opening) then operation of the motor 42 will cause the overrun clutch 30 to slip by the inward deflection of the resiliently deformable fingers 56 and disengagement of the ends 58 of the fingers 56 from the recesses 46 in the peripheral rim 44 of the input gear 42, which prevents damage to the door opener assembly. Similarly, if the door 62 has already been opened by the pusher member 16 and is then slammed shut with the pusher 16 in its extended position, the resulting inward displacement of the pusher member 16 will cause the overrun clutch 30 to slip, thereby preventing damage to the door opener assembly.

In other words, the shape and cross-section of the fingers 56 are designed to be sufficiently stiff to transfer the torque between the two gears 42, 50 of the overrun clutch 30 in order to unlatch the door 62 of the dishwasher 60 in normal operation and to be sufficiently deformable to allow relative rotation between the two gears 42, 50 of the overrun clutch 30 if the resisting force encountered by the pusher member 16 exceeds a predetermined value.

The invention is not restricted to the details of the foregoing embodiment. For example, it would be possible to provide resiliently deformable fingers projecting inwardly from the periphery of the input gear which engage with corresponding recesses in the core 52 of the output gear member 50.

In addition, the recesses which engage with the ends of the deformable fingers may be replaced with projections and the ends of the deformable fingers may be shaped to be a complementary fit with the projections.

In addition, although the embodiment has been described with reference to a dishwasher, the invention is equally applicable to other domestic appliances, for example washing machines.

The invention claimed is:

1. A door opener for a domestic appliance comprising:

a motor;

a pusher member displaceable between a retracted position and an extended position in which it is engageable with a door of a domestic appliance to open the door; and a gear train connected between an output of the motor and the pusher member, which causes displacement of the pusher member in response to operation of the motor;

the gear train comprising an overload clutch which comprises:

a first gear; and a second gear mounted coaxially with, and rotatable with respect to, the first gear; and the second gear comprising a plurality of resiliently deformable fingers, one end of each finger being releasably engageable with a complementarily-shaped portion of the first gear, and a core from which the resiliently deformable fingers extend outwardly, wherein the first gear and the second gear of the overload clutch are formed from a non-metallic material, the resiliently deformable fingers are equally angularly spaced with respect to one another around a periphery of the core, and each of the resiliently deformable fingers curves about the core, between the core and the one end of the finger that is releasably engageable with the complementarily-shaped portion of the first gear.

2. A door opener as claimed in claim 1, wherein the resiliently deformable fingers are resiliently flexible or bendable.

3. A door opener as claimed in claim 2, wherein the resiliently deformable fingers are flexible or bendable inwardly.

4. A door opener as claimed in claim 1, wherein the first gear comprises a peripheral annular rim in which the complementarily-shaped portions are formed.

5. A door opener as claimed in claim 4, wherein the second gear is seated in a recess in the first gear formed by the peripheral annular rim.

6. A door opener as claimed in claim 1, wherein the second gear comprises an output gear.

7. A door opener as claimed in claim 1, wherein the elongate pusher member is displaceable in its longitudinal direction.

8. A door opener as claimed in claim 1, wherein the pusher member comprises a rack portion and the gear train is connected between the output of the motor and the rack portion.

9. A door opener as claimed in claim 8, wherein the rack portion extends parallel to the longitudinal direction of the pusher member.

10. A door opener as claimed in claim 8, wherein the second gear is engaged with the rack portion of the pusher member.

11. A domestic appliance comprising a door opener as claimed in claim 1.

12. A dishwasher comprising a door opener as claimed in claim 1.

13. A door opener as claimed in claim 1, wherein the complementarily-shaped portions are recesses formed on an inner surface of an annular rim extending from a side of the first gear, the inner surface facing the second gear.

14. A door opener as claimed in claim 1, wherein the complementarily-shaped portions are formed on an inner surface of an annular rim of the first gear, the inner surface facing the second gear.

15. A door opener as claimed in claim 14, wherein the annular rim extends from a side of the first gear.

* * * * *